United States Patent [19]

Aghnides

[11] 4,143,821

[45] Mar. 13, 1979

[54] FLUIDIC ROTATION OF TUBED SCREW

[76] Inventor: Elie P. Aghnides, 795 Fifth Ave., New York, N.Y. 10021

[21] Appl. No.: 779,129

[22] Filed: Mar. 18, 1977

[51] Int. Cl.[2] ..... B05B 1/08

[52] U.S. Cl. ..... 239/381; 239/449

[58] Field of Search ..... 239/99, 101, 102, 380, 239/381, 391, 449

[56] References Cited

U.S. PATENT DOCUMENTS

| | | | |
|---|---|---|---|
| 1,882,241 | 10/1932 | Curran | 239/101 |
| 2,670,942 | 3/1954 | Aghnides | 239/391 |
| 2,962,224 | 11/1960 | Aghnides | 239/431 |
| 3,473,736 | 10/1969 | Heitzman | 239/102 X |
| 3,633,824 | 1/1972 | Aghnides | 239/428.5 |
| 3,734,410 | 5/1973 | Bruno | 239/102 |
| 3,801,019 | 4/1974 | Trenary et al. | 239/383 |
| 3,811,619 | 5/1974 | Aghnides | 239/428.5 |
| 3,967,783 | 7/1976 | Halsted et al. | 239/102 |
| 3,998,390 | 12/1976 | Peterson et al. | 239/102 X |

OTHER PUBLICATIONS

Encyclopedia Larousse du XX Siecle; copyright 1933; vol. RO-Z; p. 1013.

Encyclopedia Americana; vol. 2; p. 215 (1976).

Encyclopedia Britannica; vol. I; p. 1088 (1974).

*Primary Examiner*—Robert W. Saifer

*Attorney, Agent, or Firm*—William D. Hall; Geoffrey R. Myers

[57] ABSTRACT

A conduit is traversed by a screw, which screw may or may not be capable of rotating within the conduit, the screw alone, or the screw together with the conduit, become rotatable around their common axis when fluid under pressure enters from one end of the conduit, exits from the other by traversing the helical path of the screw. The construction in which the screw is rotatable within the conduit is found suitable for producing a pulsating stream of water and for building showerheads for selectively producing different types of streams, such as (a) pulsating stream, (b) spray, and (c) soft bubbly aerated stream. Various valves manually operated by a part of the showerhead perform the selection. The pulsating stream is achieved by a screw having helical threads that makes a snug fit with the inside wall of a cylindrical pipe through which the water flows; the flow rotating the screw which in turn operates a valve that at least partially interrupts the flow of water through an outlet orifice. In the case of a hand-held showerhead, the pipe containing the screw constitutes a handle for the device.

20 Claims, 16 Drawing Figures

FIG. 4
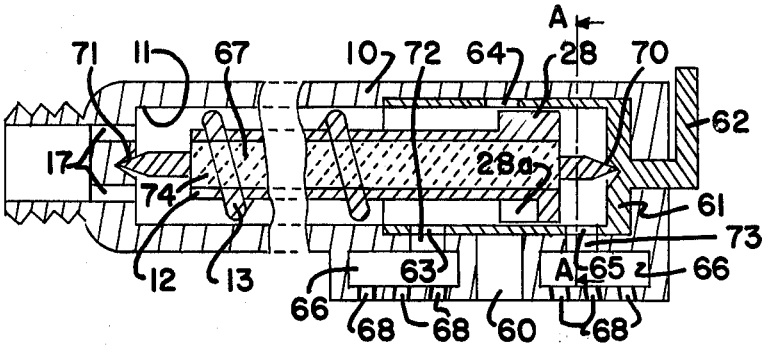
FIG. 5
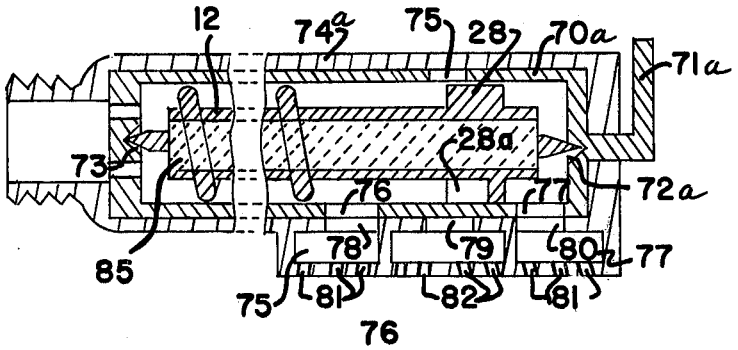
FIG. 6
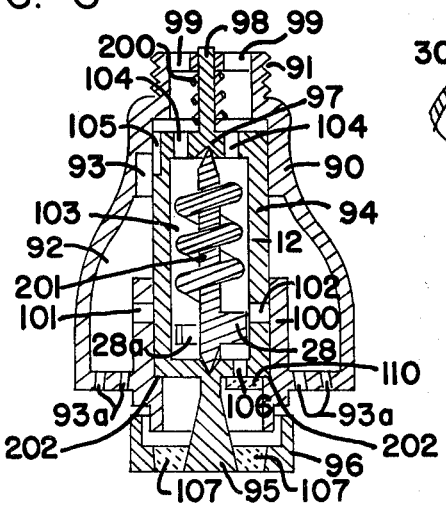
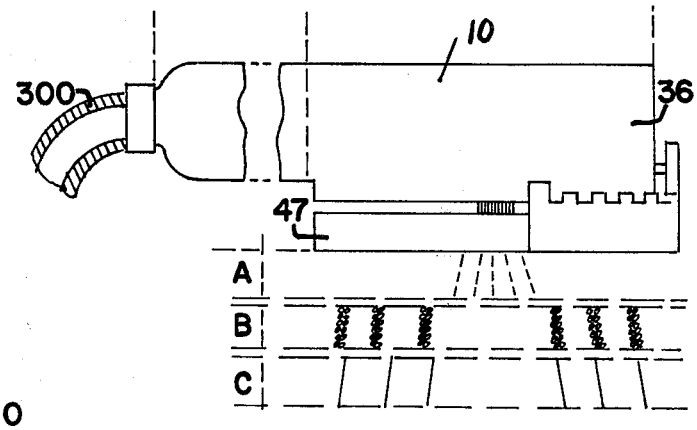
FIG. 8
FIG. 7
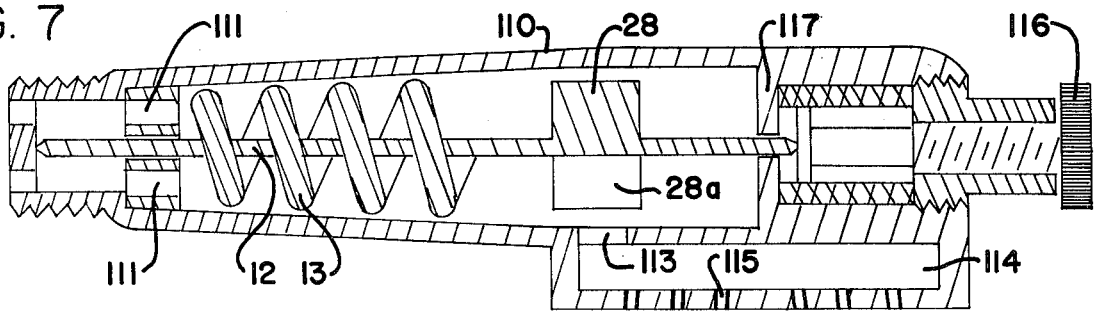

FLUIDIC ROTATION OF TUBED SCREW

BACKGROUND OF THE INVENTION

Showerheads which emit pulsating jets are well known. In general, they employ some form of water-turbine which opens and closes a valve to pulsate the water outlet. See for example U.S. Pat. No. 3,734,410 to Leonard Bruno entitled "Pulsating Spray Head", May 22, 1973; and U.S. Pat. No. 3,801,019 to John M. Trenary et al entitled "Spray Nozzle", Apr. 2, 1974.

Showerheads which emit a soft bubbly aerated stream are also well known, see my U.S. Pat. No. 3,633,824, granted Jan. 11, 1972, entitled "Spray-Producing Device In Which The Output Jets Are Aerated".

Hand-held showerheads are well known and may embody the principles of the several patents hereinabove described within the teachings of the prior art. However, such hand-held devices are unnecessarily cumbersome because the space is not utilized advantageously.

It is an object of this invention to advantageously use the space in a pipe or conduit to provide a motorized mechanism driven by the water flow, without enlargement of the pipe or conduit.

It is another object of the invention to provide a low cost and efficient showerhead having pulsating jets.

A further object of the invention is to improve the water-driven motor arrangement in pulsating-jet type of showerheads.

Another object of the invention is to provide a neat and compact hand-held showerhead.

Still another object of the invention is to provide a showerhead which is low in cost and efficient to operate.

Still another object of the invention is to provide a hand-held showerhead which is more compact and efficient than the prior art ones and which can be sold at a low cost.

Still another object of the invention is to provide a showerhead which may give at will, selectively, a pulsating stream or streams, a spray formed by bubbly streams, or a spray formed by conventional jets.

Other objects of the invention will appear as this description proceeds.

SUMMARY OF THE INVENTION

A pipe through which water flows under pressure has a screw whose axis of rotation conforms to the axis of the pipe. The helical screw threads are traversed by the water thereby rotating the screw, or the said pipe, when said screw is connected with the inner sidewall of the pipe.

In one form of the invention, the rotating screw operates a valve that intermittently reduces the water-outlet path from the conduit to produce a pulsating output stream.

When the device is used as a hand-held showerhead, or other device for projecting a pulsating stream of water, the pipe containing the screw forms a handle for the device.

The pulsating water outlet may direct the water transverse to the flow through the pipe. In addition to the pulsating-water outlet, the device may employ adjacent outlets which emit non-pulsating flow. Manually operable means may be employed to select which output or outputs will be used. One of the outputs may be a spray; however, means to aerate the water to provide soft bubbly streams may selectively be employed.

BRIEF DESCRIPTION OF THE DRAWINGS

FIG. 4 is a cross-sectional view of another hand-held showerhead according to the invention.

FIG. 5 is a cross-sectional view of still another hand-held showerhead according to the invention.

FIG. 6 is a cross-sectional view of a showerhead which is a permanent fixture, according to the invention.

FIG. 7 is a cross-sectional view of still another form of a hand-held showerhead.

FIG. 8 is a view of any one of the showerheads of FIGS. 3, 4, 5, or 7 shown connected to the flexible water input tube, employed for feeding water under pressure to the hand-held showerhead.

DETAILED DESCRIPTION OF THE DRAWINGS

Figure 1:
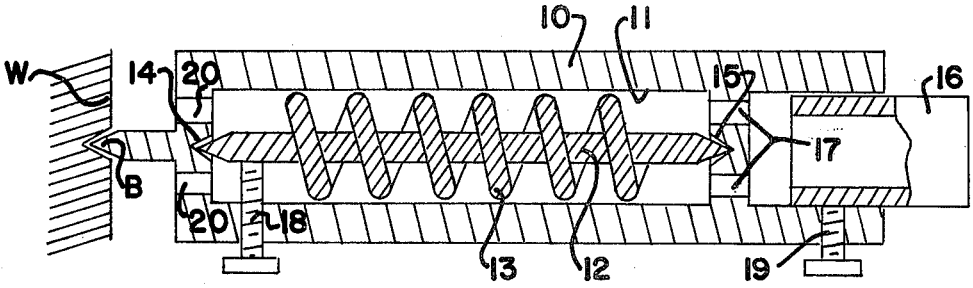
FIG. 1 is a cross-sectional view of one form of the invention.

In FIG. 1 the conduit 10 has an inner bore 11 in which a screw 12 having helical threads 13 may rotate in bearings 14 and 15. Water enters under pressure through input pipe 16 which supplies water under pressure through opening 17 into the cylindrical opening 11 inside of conduit 10. Since the helical threads 13 have a slightly smaller diameter than the inside bore 11 of conduit 10, the water passing through opening 17 causes the screw 12 to tend to rotate. If bolt 18 is loose to permit rotation of the screw 12, the latter will rotate provided the bolt 19 tightly engages the conduit 16. If, however, bolt 19 is turned so that it does not engage conduit 16 and if bolt 18 is tight so that it mechanically connects conduit 10 to screw 12, the conduit 10 together with the screw 12 will rotate around conduit 16, it being noted that the conduit has a bearing "B" engaging a fixed wall "W". Water which passes from inlets 17 through the conduit 10 may leave the conduit through exit holes 20. The rotating screw 12 may be coupled to any suitable mechanism which needs to be driven by a motor. Likewise, the rotating conduit also may be coupled to any suitable mechanism which needs to be driven.

Figure 2:
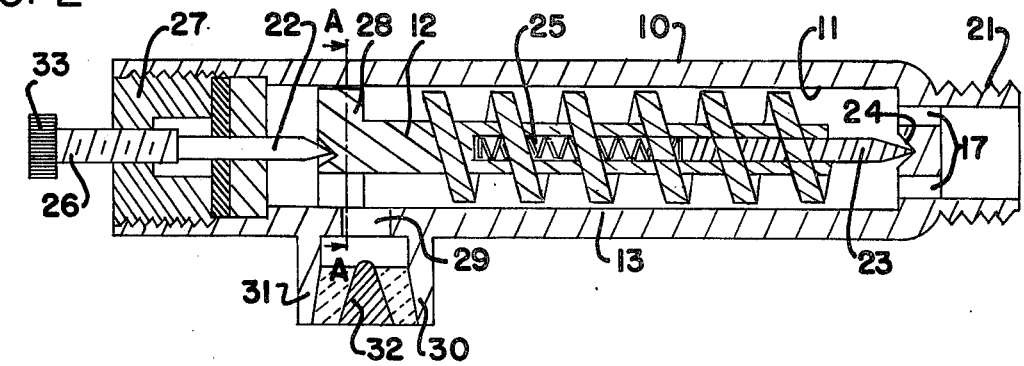
FIG. 2 is a cross-sectional view of a hand-held showerhead with a pulsating jet, according to the invention.
Figure 3B:
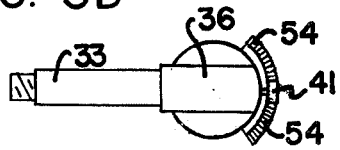
FIG. 3B is the top view of FIG. 3.

FIG. 2 is a hand-held showerhead embodying the principles of FIG. 1. The device embodies threads 21 whereby it may be connected to a flexible tube containing water under pressure, as more fully explained in connection with FIG. 8. The screw 12 is mounted for rotation upon pin 22 at one end and is carried by pin 23 which enters bearing 24 at its other end. Spring 25 presses against the left end of the pin 23 to maintain support for the screw 12. The pin 22 may be moved to the left or right by rotating knurled nut 33 which has a shaft 26 in threaded engagement with a portion of the conduit 27. The screw 12 is connected to a valve element 28 which partially closes opening 29 which extends from the inside of the conduit to the output 30 which comprises a series of holes or openings between output channel 31 and water deflector 32. In FIG. 2 the diameter of the shaft of screw 12 may be 10.5 mm., the length of the helical screw may be 75 mm., the thread 13 of the helix may be 5 mm. wide, and the space between the teeth of the thread 7 mm. The teeth project approximately 0.25 mm. between the periphery of the screw and the inner bore 11 of the conduit 10. The inner diameter of conduit 10, that is the diameter of bore 11, is 19 mm. and the overall diameter of helix 13 is 18.5 mm. The orifice 29 may be 8 × 11 mm.

In operation water under pressure enters the opening 17 and as it passes through the bore 11 in conduit 10, it rotates the screw 12 which in turn rotates the valve element 28 which varies the size of the opening 29 once each revolution of the screw. The amount of variation can be changed by rotating the knurled nut 33 to move valve element 28 to the right or to the left. If knurled nut 33 is rotated sufficiently to the right, the valve element 28 may completely close the opening 29 except during the portion of each revolution where indent **28*a* (FIG. 2A) of the valve element 28 is above the opening 29. In that case the water flow may stop, unless some water is allowed to pass even when indent 28*a* is not above orifice 29. As the knob 33 is rotated to move valve element 28 to the left, there are pulsations in the flow that change in frequency and magnitude. If knob 33 is rotated until the valve element completely clears opening 29, the output stream will no longer appreciably pulsate. The helical coil spring 25 holds the screw 12** in place at all times.

It is noted in FIG. 2 that the conduit 10 acts as a handle for the showerhead and that the location of the screw 12 in the handle is a considerable space-saving arrangement whereby a very compact and low cost showerhead is provided.

Figure 2A:
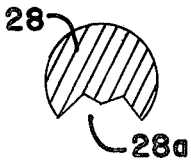
FIG. 2A is cross-section A—A of FIG. 2.
Figure 3:
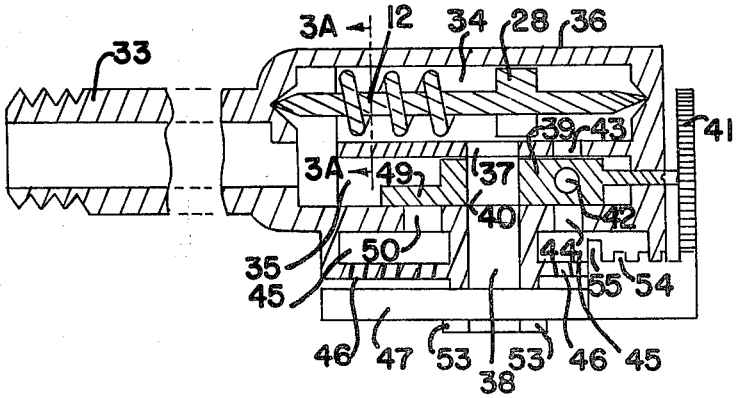
FIG. 3 is a cross-sectional view of a hand-held showerhead according to the invention, producing any one of three types of streams, (a) pulsating jet, (b) spray, and (c) aerated bubbly streams.
Figure 3A:
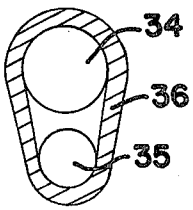
FIG. 3A is a cross-sectional view along lines 3A—3A of FIG. 3, with all internal parts omitted.
Figure 9:
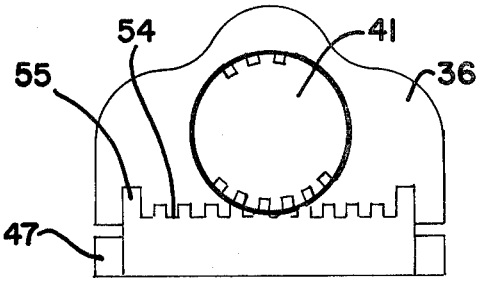
FIG. 9 is an end view of the showerhead of FIG. 3.
Figure 10:
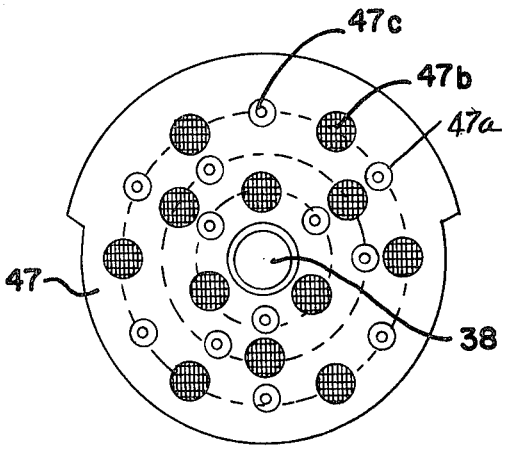
FIG. 10 is a bottom view of the rotating element 47 of the showerhead of FIG. 3.
Figure 11:
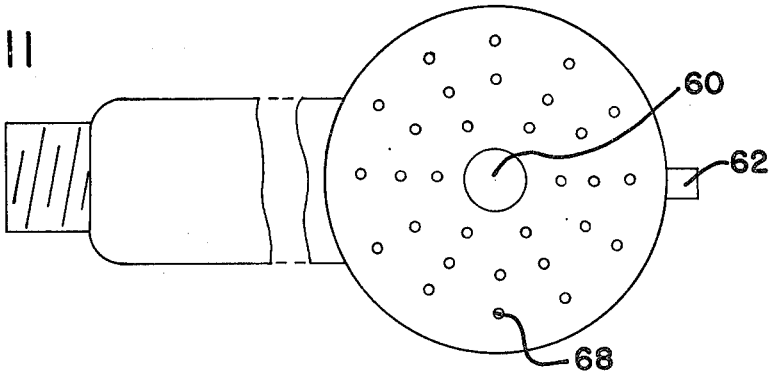
FIG. 11 is a bottom view of the showerhead of FIG. 4.

In FIG. 3 the conduit 33 has threads or other means at its left-hand end to connect the same to a flexible tube containing water under pressure. The conduit 33 communicates to conduits 34 and 35 all contained in the casing 36. The water flow through conduit 34 rotates the screw 12, as described in connection with FIGS. 1 and 2, which in turn rotates the valve element 28 which, as shown in FIG. 2A, has cut-out **28*a*, to thus pulsate the flow of water that travels from conduit 34 through opening 37 to outlet opening 38. The water leaving conduit 38 is directed upon the person or object at which the showerhead is directed. The water is permitted to flow from opening 37 to conduit 38 by reason of the fact that valve element 39, when in the position shown has an opening 40 therethrough. The opening 40 is, however, rotated away from its present position when gear 41 rotates. If that gear rotates by a sufficient angle that the hole 40 no longer connects opening 37 to conduit 38, then no water passes through the conduit 38 and the pulsating jet output of the showerhead ceases. When gear 41 is appropriately rotated, hole 42 connects passageway 43 to output passageway 44, whereby water enters annular chamber 45 and is directed downwardly through perforations or orifices 46 toward the rotating member 47 hereinafter described. At the same time valve element 49, which is integral with valve element 39, uncovers outlet port 50 allowing water coming from conduit 35 to enter said annular chamber 45 and exit through orifice or perforations 46 onto the rotating element 47, hereinafter described. Thus there are two water flow paths any one of which may be selected by selecting the desired angle to which gear 41 is rotated. In one of these angles water passes from conduit 34 through orifices 37, opening 40 and exit opening 38. At another angle of gear 41 water may pass simultaneously through orifice 43, hole 42, orifice 44, and exit openings 46 and through conduit 35, outlet port 50 and said openings 46, to impart maximum velocity to the jets issuing from holes 46. The particular type of water output from the device of FIG. 3 is selected by rotating element 47 which is pivoted to rotate about the casing 53. The element 47 carries gear teeth 54 which mate with the teeth of gear 41 to turn it to the desired angle. A stop element 55 terminates the extent to which the element 47 may be rotated. As shown in FIG. 10 the element 47 has alternate openings 47*c* which contain no screens and openings 47*b* which contain screens; an arrangement that has some similarity to my U.S. Pat. No. 2,962,224 (FIG. 1) of Nov. 29, 1960, entitled "Aerating Device for Producing Streams of Large Cross-Section", and No.3,811,619 of May 21, 1974, entitled "Spray Producing Device". When rotated to the correct angular position so that water is passing through openings 46, and screens 47*b* are located below those openings, soft bubbly aerated streams will result as more fully explained in my U.S. Pat. No. 3,633,824, hereinabove referred to. Similarly, there is an angle of rotation of element 47 which will position the screens 47*b* out of the path of the water from orifices 46 and a conventional spray, formed by the jets issuing through holes 47*c* will be produced. There is a further angular position in which openings 44 and 50 are closed and hole 40 communicates with holes 37 and conduit 38** to allow a pulsating output.

Figure 4A:
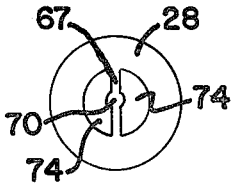
FIG. 4A is a view 4A—4A of FIG. 4.

In FIG. 4 the conduit 10 has an internal bore 11 through which the screw 12 having helical threads 13 passes. Provision is made at the left end of the device in any suitable way, such as threads, for connection to a flexible tube so that water under pressure enters ports 17 and is directed onto the screw 12 to rotate the same. At the right end of the screw 13 is a valve element 28 (FIG. 2A) and a cut-out **28*a* is employed which partially blocks output pipe 60. Assuming that valve handle 62 is rotated 180° from the position shown so that the chamber 11 communicates to output pipe 60 through hole 64, the inlet to output pipe 60 is enlarged whenever the cut-out 28*a* remains above the inlet of output pipe 60 and the output from output pipe 60 is partially closed when the solid portion of valve element 28*a* covers the output pipe 60. Valve 61 controlled by handle 62 may be used to selectively open or close the holes 63, 64, and 65 leading from the inside of conduit 10 to the annular chamber 66, through holes 72 and 73 or to the outlet pipe 60. The annular chamber 66 has outlet orifices 68**.

The openings 63, 64 and 65 in the valve element 61 may be so positioned that any one or more of the outlet pipes 68, or 60, may be selected. The conduit 10, containing the screw 12, constitutes a handle for the showerhead, and compactness is achieved by having the motor, for operating the valve element 28, to produce pulsations, located at least partly in the handle.

A water passageway 74 traverses axially screw 12 and is divided by web 67, which projects along the axis of the screw and ends to points of rotation 70 and 71, as shown by view 4A. The provision of passageway 74 increases the rate of flow and thereby the velocity of the jets discharged from holes 68.

In FIG. 5, the valve 70*a*, operated by handle 71, includes bearings 72*a* and 73 to support the screw 12 which operates the valve element 28 which has cut-out 28*a*. The valve 70 rotates within the outer casing 74, the left end of which has threads or other suitable means for connecting the same to a flexible tube or other source of water under pressure. Here again, the screw 12 is located along the center line of the conduit, an arrangement which provides a very compact and simple structure. The outer casing 74*a* has holes 75, 76 and 77 which may be aligned with openings 78, 79 and 80. The different angular rotations of handle 71 permit the operator to align hole 75 with hole 79 for the production of pulsating streams through orifices 82 or to align holes 76 and 77 with holes 78 and 80 for producing a shower from holes 81. Here again screw 12 is provided with a water passageway 85 along the axis of said screw. As in the case of FIGS. 2, 3 and 4, the outer casing 74*a* acts as a handle for the hand-held showerhead, the screw 12 being at least partly in that handle. However, the screw may be located beyond the downstream end of the handle, as shown in FIG. 3. Moreover, pulsations in the jets through hole 79 result from the rotation of valve element 28 as in the case of FIGS. 2, 3 and 4.

In FIG. 6 a casing 90 has threads 91 at its upper end for attachment for a source of water under pressure, for instance to a shower-arm. The casing 90 defines a main cavity 92 into which water may enter because of the cut-out 93, in casing 90. The water entering cavity 92 may emerge from exit ports 93*a*. There is an internal rotating element located within the casing 90, comprising an internal casing 94 which is connected by an element 95 to a manually operable flow selector 96 which also constitutes means for directing the stream of water in the desired direction. From bearing 97 projects a fixed element 98 which freely traverses an opening connected by webs 99 to casing 90. The bearing 97 is biased downwardly by spring 200 to press the internal casing 94 against the ledge 202 carried by casing 90. A valve element 100 is integral with the outer casing 90 and has an opening 101. Manually operable selector 96 rotates inner casing 94 having opening 102 which communicates with opening 101 when casing 94 is rotated by 180° from the position shown. When inner casing 94 is rotated by 180° so that orifice 101 is in alignment with the orifice 102, water entering the main chamber 103 via inlets 104 will pass into chamber 92. At this angular position of inner casing 94 the indent 105 in casing 94 is out of alignment with cut-out 93; so, therefore, water does not enter the chamber 92 via the cut-out 93. Water entering chamber 103 via inlet holes 104 rotates screw 201 to in turn rotate valve element 28 which pulsates the water flowing through orifice 102 when it is in alignment with orifice 101. There is an orifice 106 in the bottom wall of chamber 94 which is opened in one angular position of the manual selector 96 which moves away the valve 110, to allow pulsating water from chamber 103 to flow out of outlet 107.

Therefore, there are three possible water delivery paths. First, water may enter the indent 105, pass to the cut-out 93 and pass out of orifice 93*a* as non-pulsating conventional jets. A second water delivery path may flow through inlets 104 to chamber 103 and pass through openings 101 and 102 to the chamber 92 and pass out of orifices 93*a* as pulsating jets. A third water delivery path may extend through chamber 103, orifice 28*a*, orifice 106, valve 110 and outlet 110. The water discharged through this path pulsates somewhat due to the rotation of orifice 28*a*.

The particular water delivery path which is desired may be selected by rotating element 96 to the correct angle. The frequency of rotation of screw 201 and, therefore, the rate of pulsation of the water may be varied by changing the water flow past the screw as by varying the exact position of selector 96.

In FIG. 7 a conduit 110 may have a gradually increasing diameter from left to right. The left end may incorporate threads or other means for connecting the same to a suitable flexible tube containing water under pressure. The conduit 110 also acts as a handle for the showerhead and contains the screw 12 with helical threads 13. The screw 12 is rotated by water entering input ports 111. The valve 28 having cut-out 28*a*, is rotated by screw 12 to partially open and close orifice 113 to control the flow of water into chamber 114 where it may exit from orifices such as 115 to form a pulsating spray. The knurled knob 116 may be rotated counterclockwise to allow screw 12 to move to the right until such time as valve 28 completely uncovers output port 113 so that the device produces a non-pulsating jet. In this position the pressure of the water has moved screw 12 to the right, thus enlarging the passageway around the screw 12 to permit an adequate flow of water for the non-pulsating jets. When, however, knurled knob 116 is rotated clockwise until element 28 is above the outlet port 113, a pulsating output jet will result. Any intermediate position in which output port 113 is only partially open may be attained. The frequency of rotation of screw 12, and, therefore, the repetition rate of the pulses of the water, vary with the horizontal position of screw 12, as determined by knurled knob 116.

The above-referred to displacement of the screw 12 from left to right by the water pressure may be achieved also if knob 116 is integral with a rod which extends from said knob and through said screw and has a male threaded end-portion which engages female threads across the element defining said input ports 111. In such a structure, the rod is provided with ledges on both ends of the screw so that the latter may rotate around said rod but not be able to move axially in either direction. As a result, the rotation of the knob will move, backward or forward, the rod to carry along the screw positioned between said ledges.

As shown in FIG. 8, a showerhead 10, which may be any of the showerheads of FIGS. 2, 3, 4, 5 or 7, is connected at its left end to a flexible tube 300 containing water under pressure. Hence, the hand-held showerhead 10 may direct the water as a pulsating stream A, as bubbly streams B or as ordinary jets C.

Figure 12:
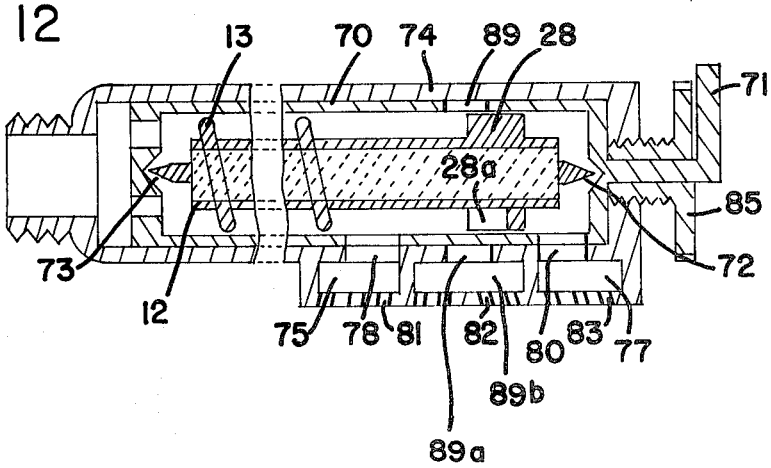
FIG. 12 is a cross-sectional view of another form of the invention.

In FIG. 12 the casing 74 employs tubular screw 12 having threads 13. The screw 12 is supported by pins 72 and 73 which operate in bearings in the form of indents located in inner tubular casing 70. The screw 12 is hollow so that water under pressure entering the left end of casing 74 may flow through screw 12 to output opening 80.

When handle 71 is in the position shown, water may pass through holes 78 and 80 to cavities 75 and 77 in casing 74. From cavities 75 and 77 water may pass out of output orifices 81 and 83.

When handle 71 is rotated by 180° the output orifice 89 is aligned with orifice 89*a* so that water may enter cavity 89*b* and pass out through holes 82. In that position, clockwise rotation of element 85 will gradually impair the alignment of holes 89 and 89*a* by moving leftward casing 70 and thereby change the frequency of the pulsation of the water discharging from holes 82.

In any of the Figures of the drawings the outermost portions of the helical thread 13 may have a flat top instead of being rounded as shown in the drawings. In such a case the surface of the helix 13 constituting its periphery would be 5 mm. wide and approximately 0.25 mm. from the tubular casing. This change is shown in FIG. 2.

I claim to have invented:

1. In a device operated by water under pressure comprising:

a conduit having an opening with an inlet end for receiving water under pressure and a showerhead comprising a hole in the side wall of said conduit, input means connecting said inlet end to a source of water under pressure, a helical screw having threads whose dimension perpendicular to its axis is slightly less than the transverse dimension of said opening, said threads including means to rotate the screw as water under pressure flows from said inlet and through said opening, and means driven by the rotation of said screw for pulsating the water fed to said hole, to thus provide a pulsating output stream from said showerhead, said hole being adjacent the downstream end of said helical screw so that water from said inlet end must pass along said helical screw and thus rotate the screw in order to reach said hole.

2. In a device operated by water under pressure comprising:

a conduit having an opening with an inlet end and also having a hole in the side wall of said conduit to constitute a water outlet forming a showerhead, input means connecting said inlet end to a source of water under pressure, a helical screw having threads whose dimension perpendicular to its axis is slightly less than the transverse dimension of said opening, said threads including means to rotate the screw as water under pressure flows from said inlet and through said opening, and means driven by the rotation of said screw for pulsating the water at said water outlet, to produce a pulsating stream, said screw having an axis of rotation, said water outlet directing water away from said conduit in a direction transverse to the axis of rotation of said screw, said water outlet being in a portion of the conduit which is of larger diameter than that of said screw and being adjacent the downstream end of said screw so that water passing from said inlet to said outlet will rotate the screw.

3. A device as defined in claim 2 in which said conduit comprises a handle surrounding said screw permitting said device to be hand-held to direct the water onto an object to be showered with pulsating water.

4. A device as defined in claim 3 in which said input means comprises a flexible tube enabling the device to be moved by hand to direct the water on the object.

5. A device as defined in claim 3 comprising said conduit including stream producing means for producing a stream other than said pulsating stream, and means for selecting a desired output stream from said pulsating stream and/or said stream producing means.

6. A device as defined in claim 2 in which said device comprises a handle permitting said conduit to be hand-held to direct the water onto an object to be showered with pulsating water.

7. A device as defined in claim 6 in which said input means comprises a flexible tube enabling the device to be moved by hand to direct the water on the object.

8. A device as defined in claim 2 including:

means for selecting an output from said outlet comprising pulsating water, a spray or aerated streams.

9. A device as defined in claim 2 comprising stream producing means for producing a stream other than said pulsating stream, and means for selecting a desired output stream from said pulsating stream and/or said stream producing means.

10. A device as defined in claim 2 comprising said conduit including stream producing means for producing a stream other than said pulsating stream, and means for selecting a desired output stream from said pulsating stream and/or said stream producing means.

11. In a device operated by water under pressure comprising:

a conduit having an opening with an inlet end and an outlet end, input means connecting said inlet end to a source of water under pressure, a helical screw having threads whose dimension perpendicular to its axis is slightly less than the transverse dimension of said opening, said threads including means to rotate the screw as water under pressure flows from said inlet and through said opening, and output means driven by the rotation of said screw, said conduit defining a water outlet, said output means comprising means for pulsating the water at said water outlet, to produce a pulsating stream, the inside diameter of the conduit being tapered so that as the distance from the inlet end of the conduit increases, the conduit enlarges.

12. In a device operated by water under pressure comprising:

a conduit having an opening with an inlet end and an outlet end, input means connecting said inlet end to a source of water under pressure, a helical screw having threads whose dimension perpendicular to its axis is slightly less than the transverse dimension of said opening, said threads including means to rotate the screw as water under pressure flows from said inlet and through said opening, output means driven by the rotation of said screw, said conduit defining a water outlet, said output means comprising means for pulsating the water at said water outlet, to produce a pulsating stream, said screw having an axis of rotation, said water outlet directing water away from said conduit in a direction transverse to the axis of rotation of said screw, said conduit comprising a handle permitting said conduit to be hand-held to direct the water onto an object to be showered with pulsating water, stream producing means for producing a stream other than said pulsating stream, means for selecting a desired output stream from said pulsating stream and/or said stream producing means, said screw having a longitudinal passageway so that water entering the input end of the conduit may pass through said hole, said stream producing means receiving water that has passed through said hole.

13. In a device operated by water under pressure comprising:

a conduit having an opening with an inlet end and an outlet end, input means connecting said inlet end to a source of water under pressure, a helical screw having threads whose dimension perpendicular to its axis is slightly less than the transverse dimension of said opening, said threads including means to rotate the screw as water under pressure flows from said inlet and through said opening, output means driven by the rotation of said screw, said conduit being mounted for rotation, a fixed input pipe feeding the input of the conduit, means for selectively restraining motion between said conduit and said pipe, and means for selectively restraining motion between the screw and the conduit.

14. A water massaging device for massaging the human body with a pulsating stream of water comprising:

water massaging means for massaging the human body with water including water discharge outlets, said water massaging means having an input, a cylindrical conduit having an inlet for receiving water under pressure and feeding the water under pressure to the input of said water massaging means, said conduit having an inner diameter, a helical screw, in said conduit, having threads whose dimension perpendicular to its axis is slightly less than said inner diameter, said threads including means to rotate the screw as water under pressure flows from said inlet and through said opening, water pulsating means operated by rotation of said screw to pulsate the water through the device, said conduit forming a handle, extending around said screw, to enable the person being massaged to hold the device.

15. A water massaging device as defined in claim 14, in which the water massaging means directs its water away from the conduit along a path of flow perpendicular to the axis of the conduit, said water massaging means being adjacent the downstream end of the screw and comprising an opening in the side wall of said conduit adjacent the downstream end of said screw so that the water from said inlet to said opening passes along said screw and rotates the same.

16. A water massaging device as defined in claim 14 in which said water pulsating means comprises a valve operated by rotation of the screw, the valve cooperating with said opening to pulsate the water.

17. A water massaging device as defined in claim 14 in which the conduit includes a by-pass path for diverting water to said water massaging means without the water passing along the threads of said screw.

18. A water massaging device for massaging the human body with a pulsating stream of water comprising:

water massaging means for massaging the human body with water including water discharge outlets, said water massaging means having an input, a cylindrical conduit having an inlet for receiving water under pressure and feeding the water under pressure to the input of said water massaging means, said conduit having an inner diameter, a helical screw, in said conduit, having threads whose dimension perpendicular to its axis is slightly less than said inner diameter, said threads including means to rotate the screw as water under pressure flows from said inlet and through said opening, and means operated by rotation of said screw to intermittently interrupt the passage of water through the device, said screw having an axial passageway for the water in addition to the passageway along the threads, both passageways feeding said water massaging means.

19. A water massaging device as defined in claim 18 comprising means for selectively allowing or preventing water flow through at least one of said passageways.

20. A water massaging device for massaging the human body with a pulsating stream of water comprising:

water massaging means for massaging the human body with water including water discharge outlets, said water massaging means having an input, a cylindrical conduit having an inlet for receiving water under pressure and feeding the water under pressure to the input of said water massaging means, said conduit having an inner diameter, a helical screw, in said conduit, having threads whose dimension perpendicular to its axis is slightly less than said inner diameter, said threads including means to rotate the screw as water under pressure flows from said inlet and through said opening, and means operated by rotation of said screw to intermittently interrupt the passage of water through the device, said screw being progressively larger in diameter as the distance downstream of the inlet to the conduit increases.

* * * * *